US007661456B2

(12) United States Patent
Dardik et al.

(10) Patent No.: US 7,661,456 B2
(45) Date of Patent: Feb. 16, 2010

(54) METHOD OF AXIAL POROSITY ELIMINATION AND REFINEMENT OF THE CRYSTALLINE STRUCTURE OF CONTINUOUS INGOTS AND CASTINGS

(75) Inventors: Irving I. Dardik, Califon, NJ (US); Ephim G. Golbraikh, Beer-Sheva (IL); Shaul L. Lesin, Meitar (IL); Arkady K. Kapusta, Beer-Sheva (IL); Boris M. Mikhailovich, Beer-Sheva (IL); Michael Khavkin, Beer-Sheva (IL); Herman D. Branover, New York, NY (US)

(73) Assignee: Energetics Technologies, LLC, Califon, NJ (US)

( * ) Notice: Subject to any disclaimer, the term of this patent is extended or adjusted under 35 U.S.C. 154(b) by 87 days.

(21) Appl. No.: 11/698,462

(22) Filed: Jan. 25, 2007

(65) Prior Publication Data

US 2007/0169915 A1 Jul. 26, 2007

Related U.S. Application Data

(60) Provisional application No. 60/762,356, filed on Jan. 25, 2006.

(51) Int. Cl.
*B22D 11/00* (2006.01)

(52) U.S. Cl. ..... 164/468; 164/504

(58) Field of Classification Search ..... 164/466–468, 164/502–504

See application file for complete search history.

(56) References Cited

U.S. PATENT DOCUMENTS

| | | | | |
|---|---|---|---|---|
| 4,478,273 | A * | 10/1984 | Hanas | 164/468 |
| 4,594,723 | A * | 6/1986 | Folgero et al. | 373/142 |
| 6,619,377 | B1 * | 9/2003 | Etay et al. | 164/466 |
| 7,243,701 | B2 * | 7/2007 | Dvoskin et al. | 164/469 |

* cited by examiner

*Primary Examiner*—Jessica L. Ward
*Assistant Examiner*—Steven Ha
(74) *Attorney, Agent, or Firm*—Greenberg Traurig, LLC

(57) ABSTRACT

Apparatus and methods are provided for eliminating axial porosity accompanied by impurity segregation arising at bulk crystallization of the axial zone of the liquid core of a continuous ingot.

29 Claims, 7 Drawing Sheets

300

300

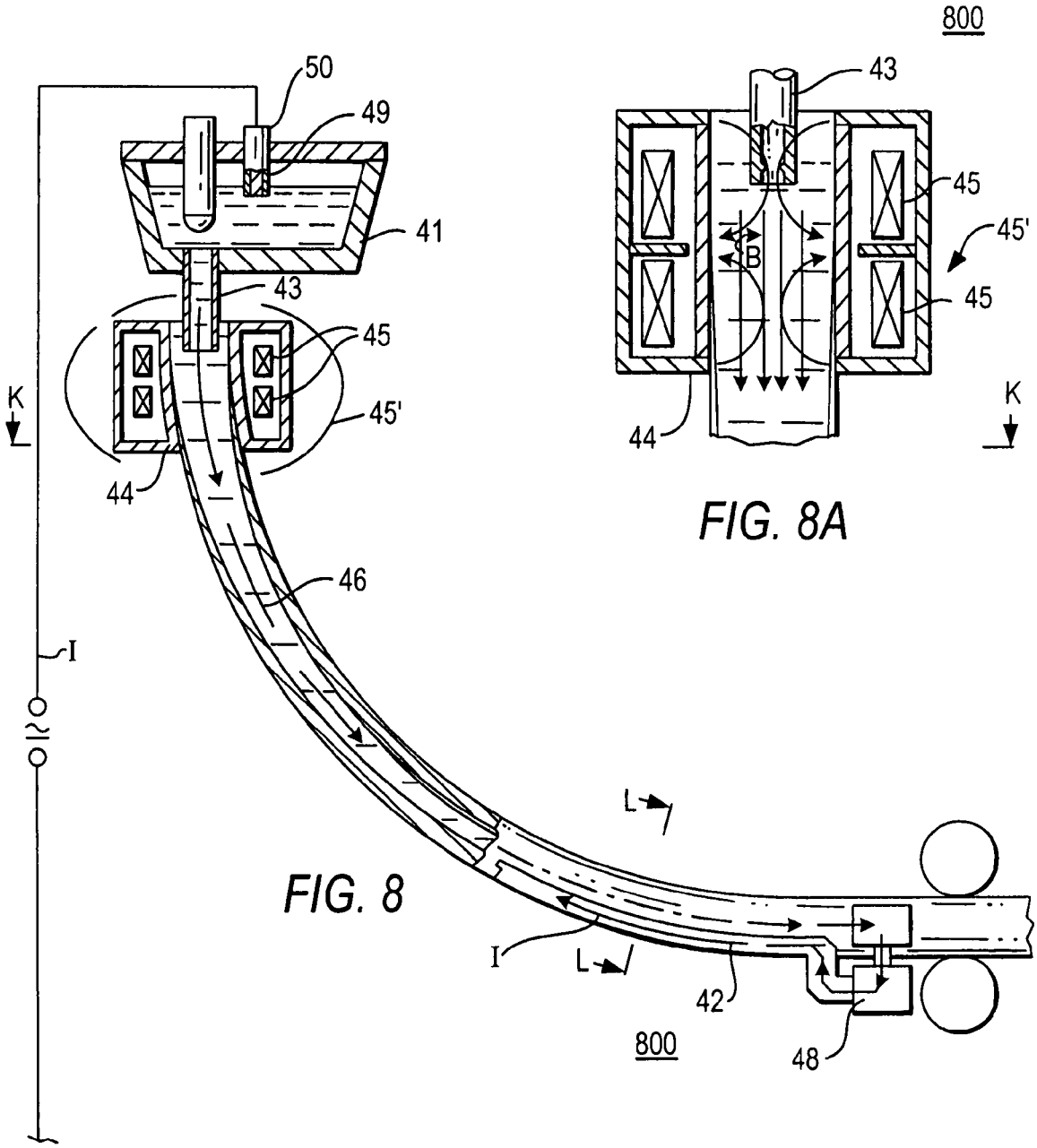
FIG. 8
FIG. 8A
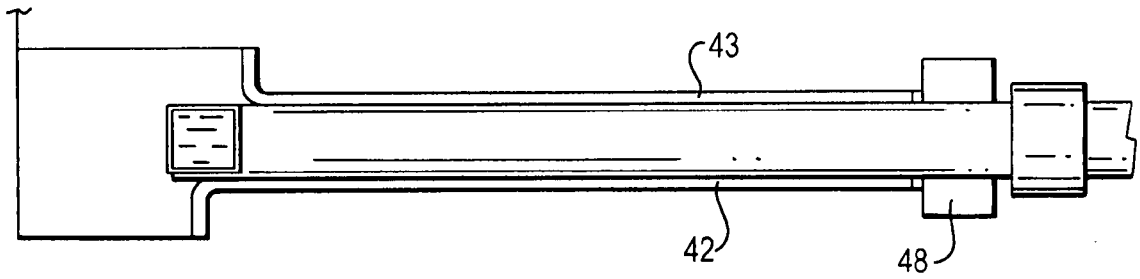
FIG. 8B
800

METHOD OF AXIAL POROSITY ELIMINATION AND REFINEMENT OF THE CRYSTALLINE STRUCTURE OF CONTINUOUS INGOTS AND CASTINGS

This application claims the benefit of U.S. provisional patent application No. 60/762,356, filed Jan. 25, 2006, which is hereby incorporated by reference herein in its entirety.

BACKGROUND OF THE INVENTION

Most steel billets of circular, square, and rectangular cross-sections are produced on continuous casting plants. One of the most wide-spread internal defects of a continuous ingot is axial porosity accompanied by impurity segregation arising at bulk crystallization of the axial zone of the liquid core of the ingot.

Electromagnetic stirring of the liquid core using rotating magnetic fields (RMF) at the mold level practically does not affect the process of axial porosity formation. RMF application in the lower part of the liquid core of the ingot, at the strand level, is ineffective due to a high viscosity of the overcooled melt, because of a high concentration of solid nuclei (crystallization centers) in the melt and large thickness of the solid phase, which requires a considerable increase in the power of RMF inductors.

If billets possess axial porosity, the quality of products obtained by plastic deformation cannot be guaranteed. Therefore, the elimination of this flaw is an important technological problem.

The efficiency of previous attempts to solve this problem by various methods (e.g., by exciting ultrasonic oscillations using an additional RMF inductor or by exciting low-frequency oscillations of the melt using RMF inductors) were insufficient. It is therefore an object of the invention to provide a method for eliminating axial porosity accompanied by impurity segregation arising at bulk crystallization of the axial zone of the liquid core of a continuous ingot.

SUMMARY OF THE INVENTION

According to the invention, a method of highly effective impact on the process of continuous ingots and castings crystallization is provided, which can combine excitation of intense oscillations of the liquid core of an ingot (or casting) with its simultaneous intense rotation around the ingot axis. In accordance with the invention, there is provided a method of axial porosity elimination and refinement of the crystalline structure of a continuous ingot and casting. The method can include passing direct or alternating electric current through a nozzle or free jet or casting head and a liquid core of the continuous ingot or casting. The method can also include exciting a constant or alternating magnetic field in the liquid core of the continuous ingot or casting, wherein the current may be capable of originating a pulsating pinch-effect in the nozzle, jet, or casting head.

In accordance with the invention, there is also provided a method of passing direct, alternating, or modulated electric current through the liquid core of a continuous ingot with the strength exceeding the critical value. The method can also include exciting a pulsating pinch-effect in the nozzle or in the casting head with simultaneous excitation of axial constant or alternating magnetic field within the continuous casting plant mold, and exciting a two-dimensional constant or alternating rotation-symmetrical magnetic field in the liquid core of the continuous ingot from the lower edge of the mold to the liquid phase bottom.

BRIEF DESCRIPTION OF THE DRAWINGS

The above and other advantages of the invention will be more apparent upon consideration of the following detailed description, taken in conjunction with the accompanying drawings, in which like reference characters refer to like parts throughout, and in which:

FIG. 8 is a schematic cross-sectional view of a portion of a continuous steel casting plant according to a fifth embodiment of the present invention;

FIG. 8A is a detailed schematic cross-sectional view of a particular portion of the continuous steel casting plant of FIG. 8;

FIG. 8B is a schematic cross-sectional view of a portion of the continuous steel casting plant of FIGS. 8 and 8A, taken from line K-K of FIG. 8;

DETAILED DESCRIPTION OF THE INVENTION

Apparatus and methods are provided for eliminating axial porosity accompanied by impurity segregation arising at bulk crystallization of the axial zone of the liquid core of a continuous ingot, and are described below with reference to FIGS. 1-12.

Figure 1:
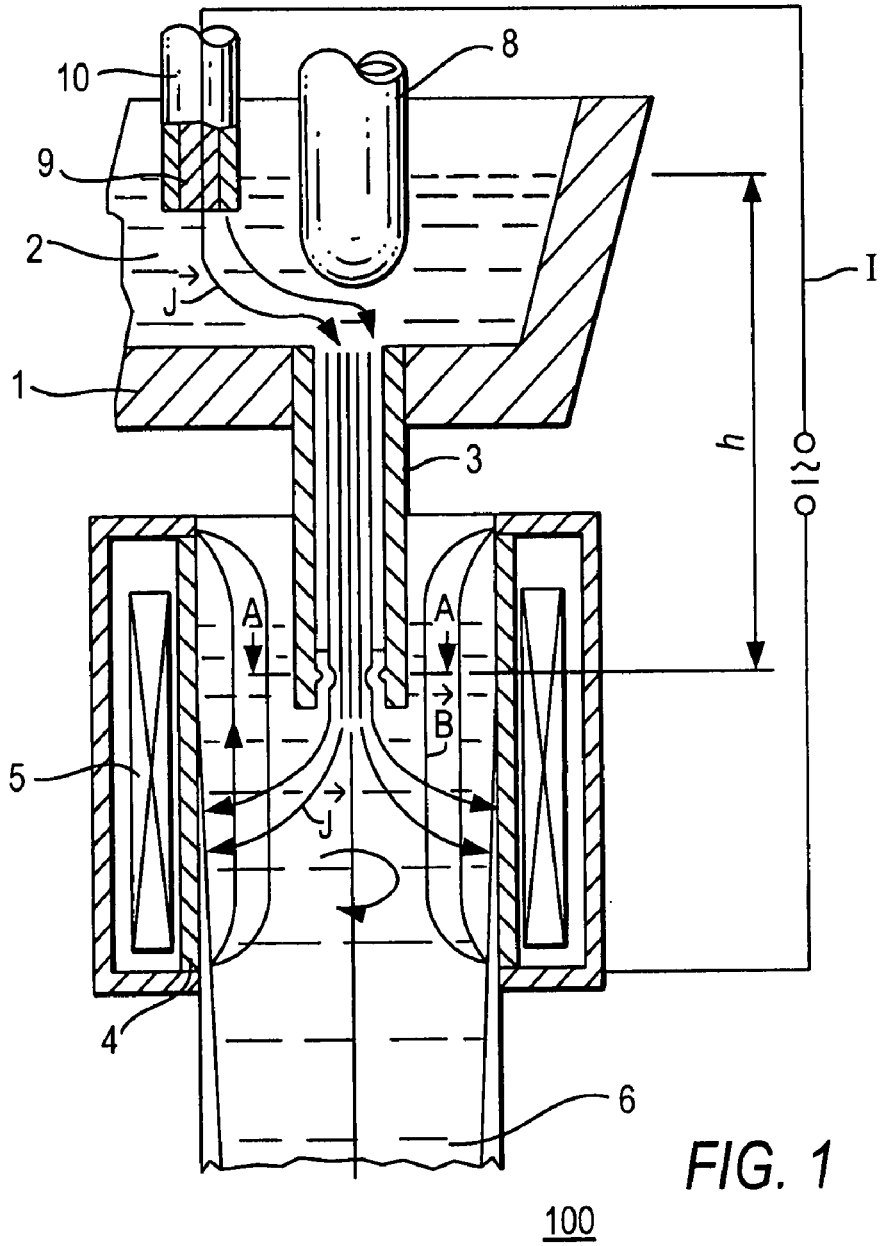
FIG. 1 is a schematic cross-sectional view of a continuous steel casting plant according to a first embodiment of the present invention.
Figure 2:
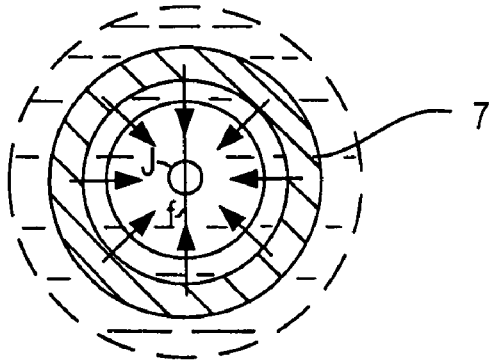
FIG. 2 is a schematic cross-sectional view of a portion of the continuous steel casting plant of FIG. 1, taken from line A-A of FIG. 1.

FIGS. 1 and 2 show a continuous casting plant 100 in accordance with a first embodiment of the invention. FIG. 1, for example, may show the distribution of conductively applied current density field and magnetic field excited by a coil in continuous casting plant 100, while FIG. 2, for example, may show pinch-effect excitation in the nozzle of continuous casting plant 100.

As shown in FIGS. 1 and 2, for example, continuous casting plant 100 can include an electrode 9 in cover 10 of tundish 1. Tundish 1 can be coupled to nozzle 3 of liquid core 6 that may have a continuous ingot, and internal wall 4 of the mold.

Wall 4 may be made of any suitable material, such as copper, for example. Electrode 9 may be made of any suitable material, such as graphite, for example. Cover 10 may be made of any suitable material, such as ceramics, for example.

Figure 3:
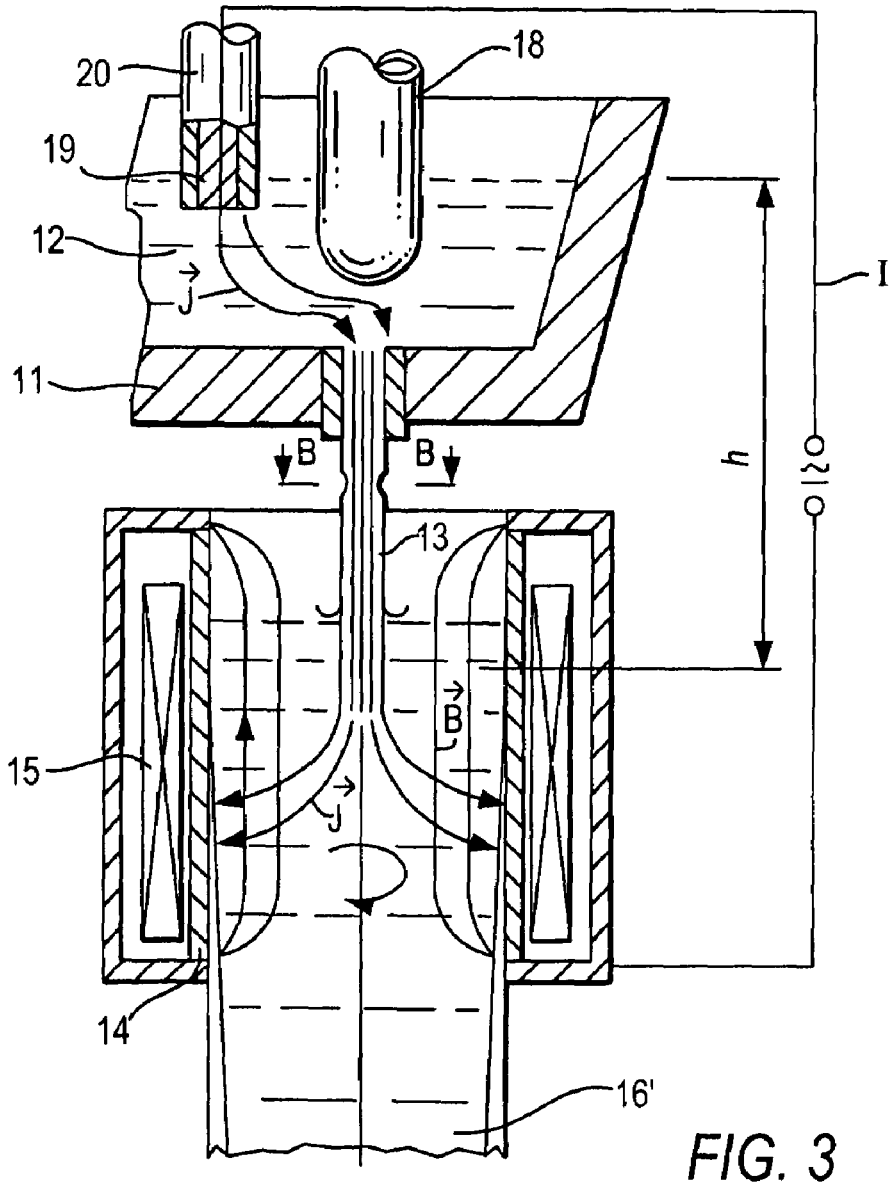
FIG. 3 is a schematic cross-sectional view of a continuous steel casting plant according to a second embodiment of the present invention.
Figure 4:
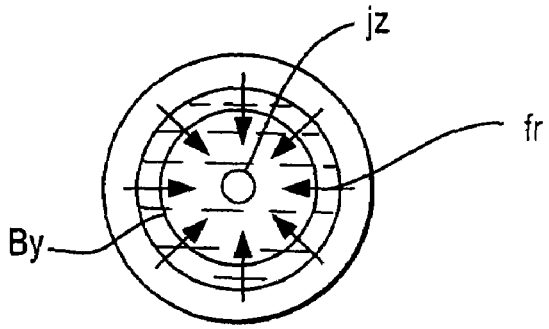
FIG. 4 is a schematic cross-sectional view of a portion of the continuous steel casting plant of FIG. 3, taken from line B-B of FIG. 3.

FIGS. 3 and 4 show a continuous casting plant 300 in accordance with a second embodiment of the invention. FIGS. 3 and 4, for example, may show pinch-effect excitation in a jet flowing out of a tundish in continuous casting plant 300.

As shown in FIGS. 3 and 4, for example, continuous casting plant 300 can include an electrode 19 in cover 20 of tundish 11. Tundish 11 can be coupled to nozzle 13 of liquid core 16 that may have a continuous ingot, and internal wall 14 of the mold. Wall 14 may be made of any suitable material, such as copper, for example. Electrode 19 may be made of any suitable material, such as graphite, for example. Cover 20 may be made of any suitable material, such as ceramics, for example.

Figure 5:
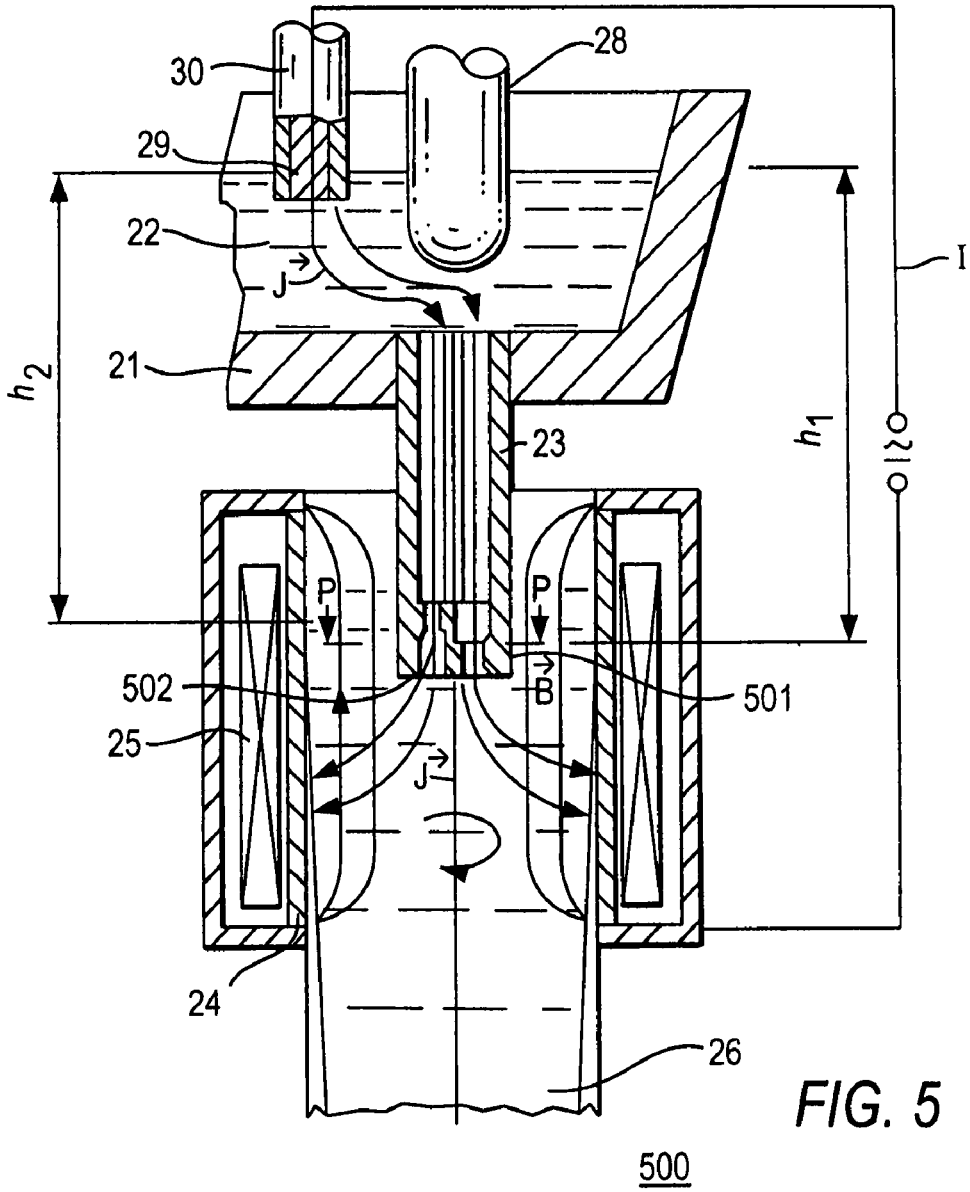
FIG. 5 is a schematic cross-sectional view of a continuous steel casting plant according to a third embodiment of the present invention.
Figure 6:
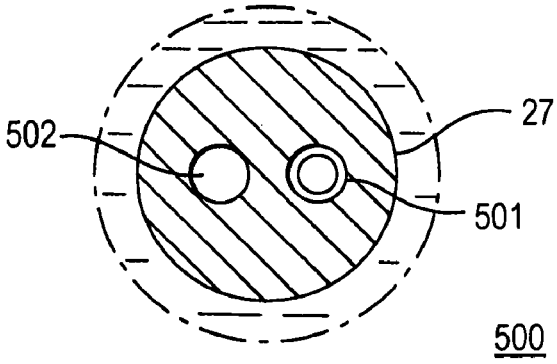
FIG. 6 is a schematic cross-sectional view of a portion of the continuous steel casting plant of FIG. 3, taken from line B-B of FIG. 3.

FIGS. 5 and 6 show a continuous casting plant 500 in accordance with a third embodiment of the invention. FIG. 5, for example, may show the distribution of conductively applied current density field, exciting two-cycle pulsating pinch-effect, and magnetic field excited by a coil in continuous casting plant 500, while FIG. 6, for example, may show two-cycle pulsating pinch-effect excitation in the nozzle of continuous casting plant 500.

As shown in FIGS. 5 and 6, for example, continuous casting plant 500 can include an electrode 29 in cover 30 of tundish 21. Tundish 21 can be coupled to nozzle 23 of liquid core 26 that may have a continuous ingot, and internal wall 24 of the mold. Wall 24 may be made of any suitable material, such as copper, for example. Electrode 29 may be made of any suitable material, such as graphite, for example. Cover 30 may be made of any suitable material, such as ceramics, for example.

Figure 7:
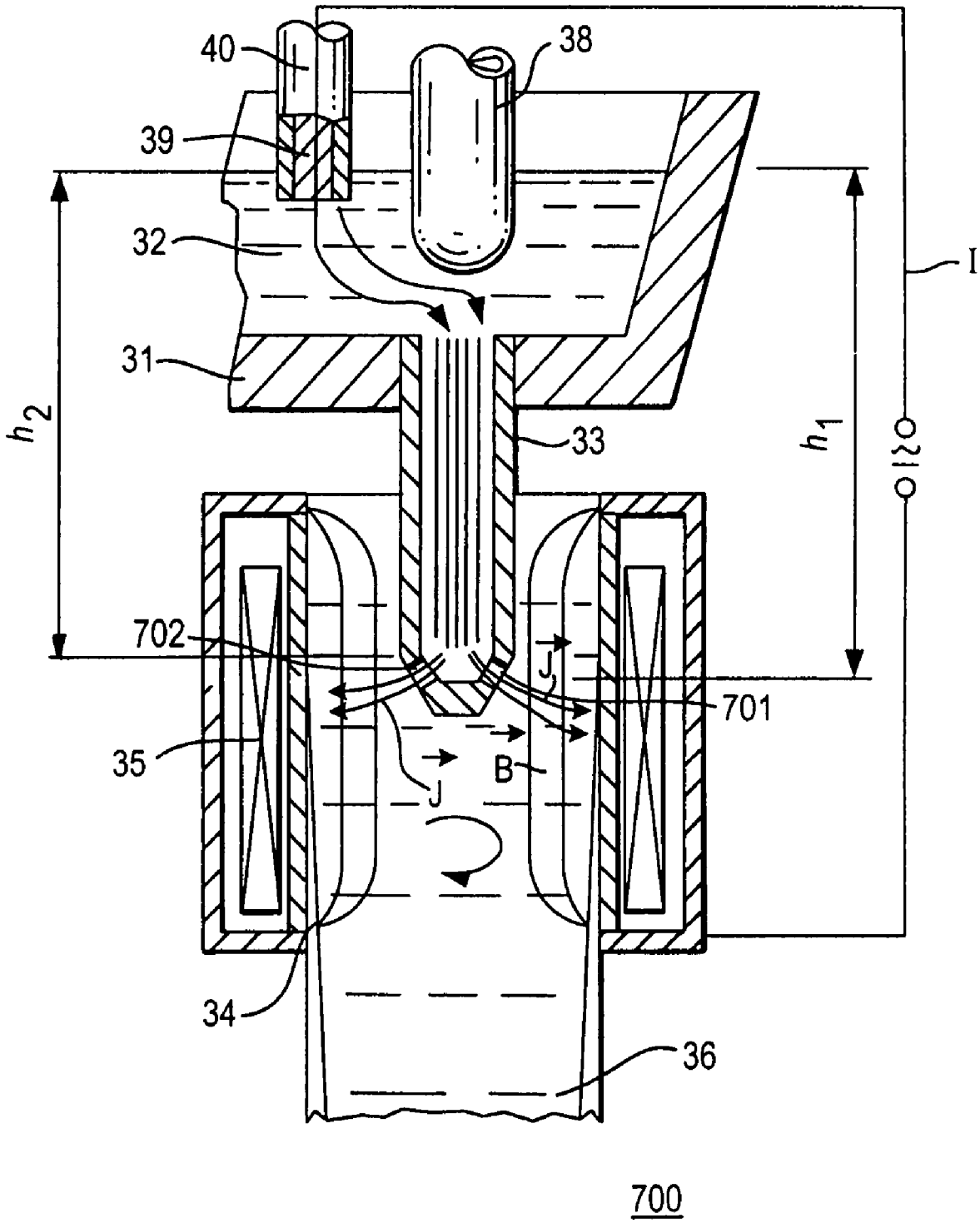
FIG. 7 is a schematic cross-sectional view of a continuous steel casting plant according to a fourth embodiment of the present invention.

FIG. 7 shows a continuous casting plant 700 in accordance with a fourth embodiment of the invention. FIG. 7, for example, may show the distribution of conductively applied current density field, exciting two-cycle pulsating pinch-effect, and magnetic field excited by a coil in continuous casting plant 700. Melt outflow of the nozzle of plant 700 may be through two lateral holes located at different distances from the melt surface.

As shown in FIG. 7, for example, continuous casting plant 700 can include an electrode 39 in cover 40 of tundish 31. Tundish 31 can be coupled to nozzle 33 of liquid core 36 that may have a continuous ingot, and internal wall 34 of the mold. Wall 34 may be made of any suitable material, such as copper, for example. Electrode 39 may be made of any suitable material, such as graphite, for example. Cover 40 may be made of any suitable material, such as ceramics, for example.

Figure 9:
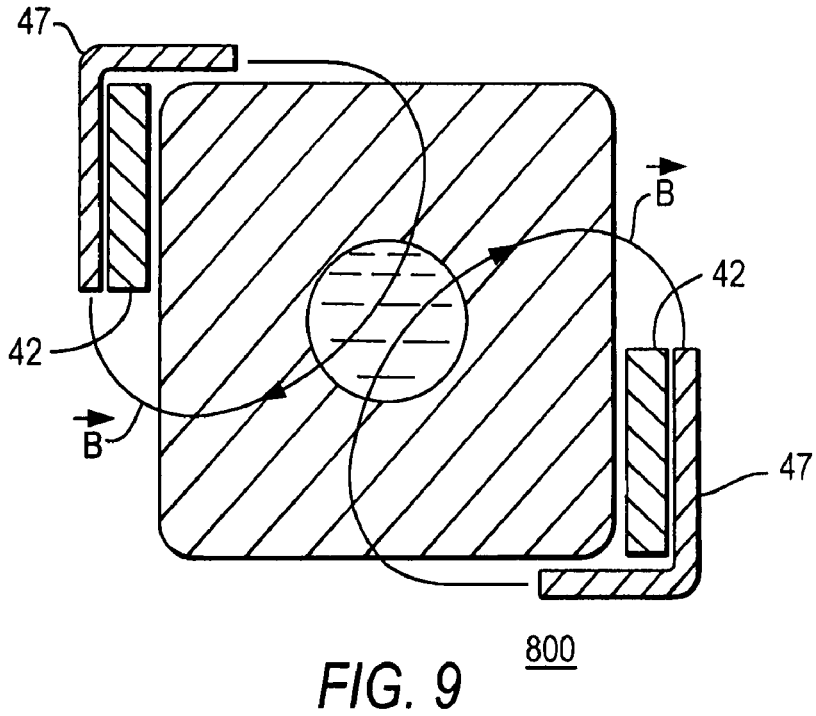
FIG. 9 is a schematic cross-sectional view of a portion of the continuous steel casting plant of FIGS. 8-8B, taken from line L-L of FIG. 8.

FIGS. 8-9 show a continuous casting plant 800 in accordance with a fifth embodiment of the invention. FIGS. 8-8B, for example, may show the distribution of conductively applied current density field, radial magnetic field excited by coils, and two-dimensional rotationally-symmetric magnetic field in continuous casting plant 800, while FIG. 9, for example, may show the distribution of a two-dimensional rotationally-symmetric magnetic field excited by a system of external buses in a section of a continuous ingot of continuous casting plant 800.

As shown in FIGS. 8-9, for example, continuous casting plant 800 can include an electrode 49 in cover 50 of tundish 41. Tundish 41 can be coupled to nozzle 43 of liquid core 46 that may have a continuous ingot, and internal wall 44 of the mold. Wall 44 may be made of any suitable material, such as copper, for example. Electrode 49 may be made of any suitable material, such as graphite, for example. Cover 50 may be made of any suitable material, such as ceramics, for example.

With respect to each of continuous casting plant 100 (FIGS. 1 and 2), plant 300 (FIGS. 3 and 4), plant 500 (FIGS. 5 and 6), plant 700 (FIG. 7), and plant 800 (FIGS. 8-9), respectively, using the electrode (e.g., electrode 9/19/29/39/49) in the cover (e.g., cover 10/20/30/40/50), a direct or alternating current may be passed through the tundish (e.g., tundish 1/11/21/31/41), the nozzle (e.g., nozzle 3/13/23/33/43), and liquid core (e.g., core 6/16/26/36/46) of a continuous ingot, and internal wall (e.g., wall 4/14/24/34/44) of the mold. The strength I of such a current can exceed the critical strength of the onset of pulsating pinch-effect determined by the following equation:

$$I_{cr} \geq \pi R_0 \sqrt{\frac{2\rho g h}{\mu_0}}, \tag{1}$$

where $R_0$ may be the radius of the liquid conductor (or melt) (m), h may be the height of the melt column above the zone of pinch-effect origination (m), ρ may be the melt density (kg/m$^3$), g may be equal to 9.81 m/s$^2$, and $\mu_0$ may be equal to $4\pi \cdot 10^{-7}$ (Hn/m) (i.e., the magnetic constant of a vacuum).

Pulsating pinch-effect can arise either in a nozzle 3 (FIGS. 1 and 2) or in a free jet 13 (FIGS. 3 and 4) as a result of interaction of axial current with the density $j_z$ with the magnetic field $B_\varphi$ of this current, which may lead to the appearance of radial forces $f_r$, whose pressure may compress the liquid conductor (melt). As far as this pressure is balanced by the hydrostatic pressure ρgh, the liquid conductor may not be deformed. If the electromagnetic pressure exceeds the hydrostatic one, the liquid conductor surface may start being deformed in the place where the cross-sectional area of the liquid conductor is minimal, and, after a very short time, the liquid conductor break accompanied by a shock wave generation may occur.

The conductor breaking can lead to the electric circuit break and disappearance of the electric current therein. This may be accompanied by the removal of electromagnetic pressure, and hydrostatic pressure may recover the continuity of the liquid conductor. This, in turn, can lead to the electric circuit closure and to the appearance of current in the conductor.

Then, the breaking and closure of the electric circuit may be periodically repeated at a certain frequency depending on the process parameters. When using alternating current, pinch-effect pulsations frequency can depend on the current frequency, because pinch-effect can arise only at the maximal value of sinusoidally varying current. Excitation of low-frequency acoustic waves may positively affect the elimination of axial porosity of an ingot.

To excite two-cycle pulsating pinch-effect, a nozzle 23 (FIGS. 5 and 6) or nozzle 33 (FIG. 7) may be realized in the form of a tube closed on the end face, with two holes 501 and 502 (FIGS. 5 and 6) or holes 701 and 702 (FIG. 7) that can provide melt feeding into the ingot liquid core. One of the holes may be located at the distance $h_1$, from the melt surface, and another may be located at the distance $h_2<h_1$. Since the critical current value is proportional to √h, it may prove to be lower for the hole 2 (e.g., hole 502 or 702) than for the hole 1 (e.g., hole 501 or 701), and the pinch-effect may arise in the hole 2. Break of the electric circuit passing through the hole 2 can lead to doubling of the current through the hole 1, and the pinch-effect can arise therein, thereby breaking the electric circuit passing through the hole 1. This, in turn, may double the current passing through the hole 2 and may cause pinch-effect therein. This process may be periodically repeated. Acoustic waves propagating along the ingot liquid core can prevent the origination of axial porosity.

At the application of direct or alternating current to a coil 5 (FIGS. 1 and 2), coil 15 (FIGS. 3 and 4), coil 25 (FIGS. 5 and 6), or coil 35 (FIG. 7), an axial magnetic field may be excited in the upper part of the liquid core 6 (FIGS. 1 and 2), core 16 (FIGS. 3 and 4), core 26 (FIGS. 5 and 6), or core 36 (FIG. 7) of a continuous ingot, whose interaction with the radial component of current density may generate azimuthal electromagnetic body forces (EMBF). If such a magnetic field is constant, the effect of EMBF can generate torsional oscillations with a frequency equal to that of pinch-effect pulsations. If the magnetic field and current vary in time with the same frequency, the effect of EMBF may generate mean rotary motion of the melt and torsional oscillations with a doubled frequency. It is to be noted that the constant magnetic field may not be shielded by the internal copper wall of the mold, at least in certain embodiments.

At the application of direct or alternating current to two coils connected in opposite directions, such as coils 45 (see, e.g., FIGS. 8-9), a magnetic field with a large radial component may be excited in the upper part 45' of the liquid core 46 of a continuous ingot. When electric current is passed through the entire liquid core of the ingot and two external buses 42 (see, e.g., FIG. 8), which may have a rectangular cross-section, are arranged in a rotationally symmetrical manner around the ingot axis (see, e.g., FIG. 9), interaction of the axial current with the radial magnetic field may generate mean rotary motion of the melt and azimuthal oscillations with the frequency of pinch-effect pulsations or doubled frequency of the alternating current in the upper part of the liquid core of the ingot. In the remaining part of the liquid core down to the bottom, interaction of a rotationally symmetrical magnetic field with the axial current may generate mean rotary motion of the melt and azimuthal oscillations with the frequencies. The use of ferromagnetic backs 47 (see, e.g., FIG. 9) may decrease magnetic leakage, which may thereby increase, 2- to 3-fold, for example, the velocity of the rotary motion of the melt.

Application of such a method may allow intense stirring of the liquid core of the ingot over its entire length, and the heat dispersed by the current may thereby prevent the formation of axial zone of bulk crystallization of the melt and axial porosity of the ingot.

Figure 10:
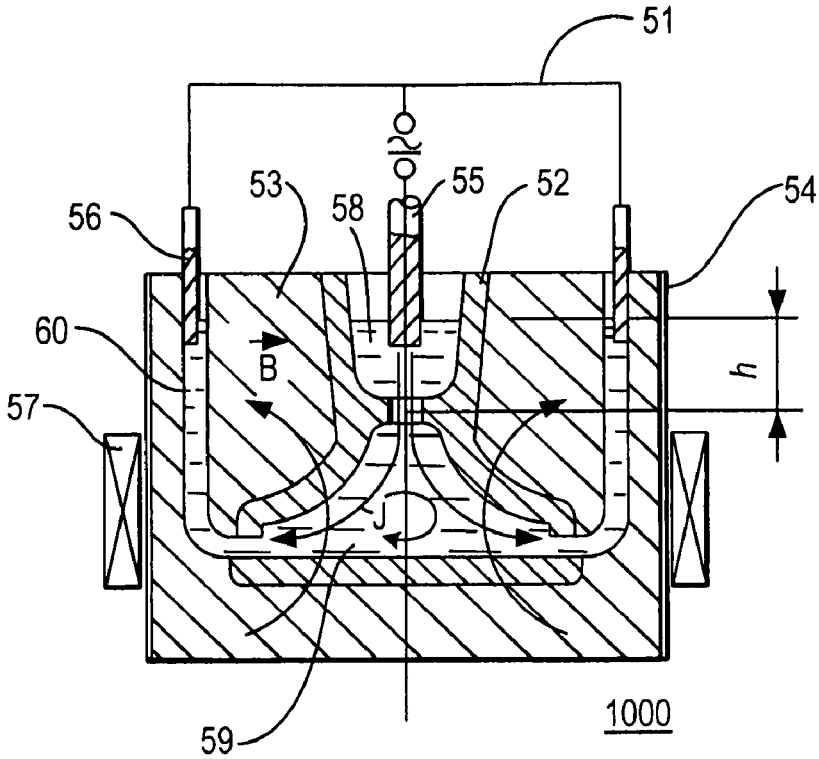
FIG. 10 is a schematic cross-sectional view of a casting mold according to a first embodiment of the present invention.

FIG. 10 shows a casting mold 1000 in accordance with a first embodiment of the invention. FIG. 10, for example, may show the distribution of conductively applied current density field and magnetic field excited by a coil in casting mold 1000.

Figure 11:
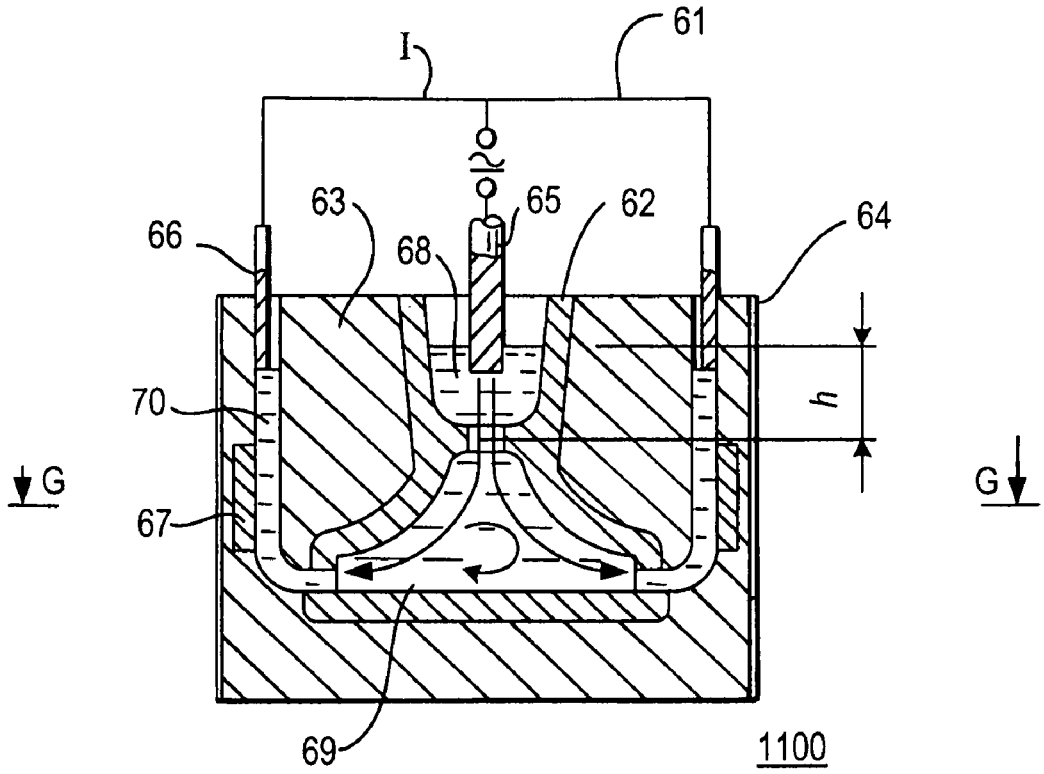
FIG. 11 is a schematic cross-sectional view of a casting mold according to a second embodiment of the present invention.
Figure 12:
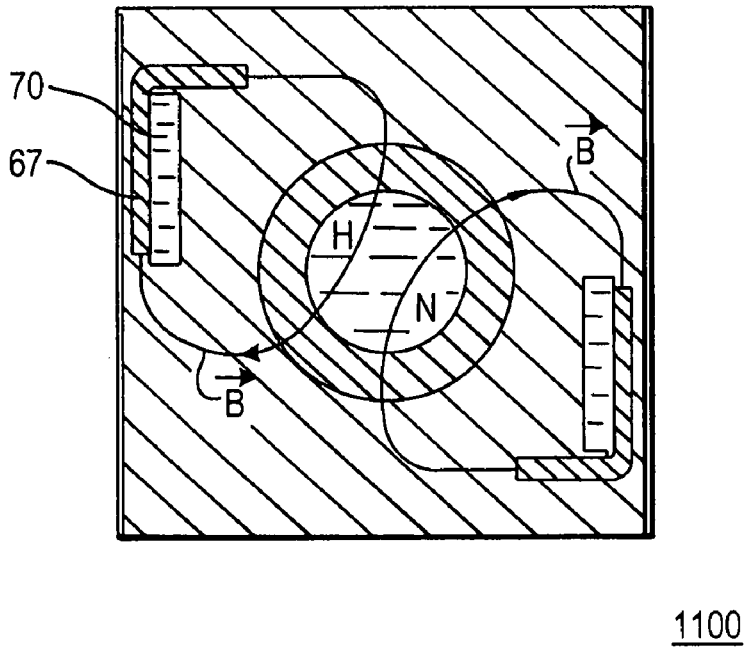
FIG. 12 is a schematic cross-sectional view of a portion of the casting mold of FIG. 11, taken from line G-G of FIG. 11.

FIGS. 11 and 12 show a casting mold 1100 in accordance with a second embodiment of the invention. FIG. 11, for example, may show the distribution of current density field in casting mold 1100, while FIG. 12, for example, may show the distribution of magnetic field excited by a system of two rotationally-symmetric air gates in casting mold 1100.

A direct or alternating current may be passed through a casting head 58 (FIG. 10) or head 68 (FIGS. 11 and 12), a casting body 59 (FIG. 10) or body 69 (FIGS. 11 and 12), and air gates 60 (FIG. 10) or gates 70 (FIGS. 11 and 12). The strength I of such a current exceeding the critical strength of the onset of pulsating pinch-effect may be determined by equation (1) above.

Pulsating pinch-effect can arise in the neck connecting the external part 58 (FIG. 10) or external part 68 (FIGS. 11 and 12) with the casting body 59 (FIG. 10) or body 69 (FIGS. 11 and 12) as a result of interaction of axial current with the density $j_z$ with the magnetic field $B_\phi$ of this current. This may lead to the appearance of radial forces $f_r$, whose pressure may compress the liquid conductor (melt). Further process of the onset of pulsating pinch-effect in the casting may not differ from the process in a continuous ingot described in item 1, for example.

At the application of a direct or alternating current to coil 57 (FIG. 10), a magnetic field can be excited in the liquid core of casting 59 (FIG. 10), whose axial component $B_z$ may interact with the radial component of the current density $j_r$. As a result of this interaction, the melt may be set in rotary motion with torsional oscillations.

Simultaneous effect of pressure pulsations generated by pinch-effect and rotary motion with torsional oscillations may ensure the production of castings with dense fine-grain crystalline structure.

When using rotationally symmetrical air gates 70 (see, e.g., FIGS. 11 and 12), which may be of rectangular cross-section, for example, the current flowing through the air gates may excite rotationally symmetrical magnetic field B, whose radial component $B_r$ may interact with the axial component of the current density $j_z$. This interaction can generate azimuthal EMBFs that set the melt in rotary motion with torsional oscillations. The use of ferromagnetic backs 67 (see, e.g., FIGS. 11 and 12) can decrease magnetic leakage, which may enhance the effect of forcing.

Application of this method of castings production may also lead to a significant positive influence on their structure.

Application of amplitude- or frequency-modulated magnetic fields excited in the liquid core of continuous ingots and castings can significantly increase turbulence intensity in the melt, which may be beneficial for the crystalline structure of said ingots and castings, and may contribute to the production of high-quality castings.

In FIGS. 1, 3, 5, and 7, for example, the casting plant may include a stopper (e.g., stopper 8, 18, 28, or 38, respectively). In FIGS. 10 and 11, the casting mold may include an external electric circuit 51 or 61, respectively, a shell 52 or 62, respectively, a heat insulation padding 53 or 63, respectively, a metal jacket 54 or 64, respectively, and current-carrying electrodes 55 and 56 or 65 and 66, respectively.

What is claimed is:

1. A method of casting a continuous ingot having improved axial porosity elimination and refinement of the crystalline structure, the method comprising:

passing an electric current through at least one of a nozzle, free jet, and casting head and a liquid core of the continuous ingot;

and exciting at least one magnetic field in the liquid core of the continuous ingot, wherein the current generates a pulsating pinch-effect in the at least one of the nozzle, jet, and casting head wherein the current is controlled such that an electromagnetic pressure corresponding to the current periodically exceeds a hydrostatic pressure of the liquid conductor to deform and break the continuity of the liquid conductor, generating a pulsating pinch-effect.

2. A method according to claim 1, wherein an axial magnetic field is excited in a mold bore of the continuous ingot, and a two-dimensional rotation-symmetric magnetic field is excited along the length of the liquid core below the mold.

3. A method according to claim 1, wherein a radial magnetic field is excited in a mold bore of the continuous ingot, and a two-dimensional rotation-symmetric magnetic field is excited along the length of the liquid core below the mold.

4. A method according to claim 1, wherein the oscillation frequency in the liquid core of the continuous ingot is controlled by varying the frequency of alternating current passed through the at least one of the nozzle, jet, and casting head.

5. A method according to claim 1, wherein pinch-effect is excited in the lower part of the at least one of the nozzle, jet, and casting head.

6. A method according to claim 1, wherein two-cycle pulsating pinch-effect is used.

7. A method according to claim 1, wherein a rotating flow of the liquid core of the ingot is excited as a result of interaction of the current and at least one alternating magnetic field.

8. A method according to claim 1, wherein torsional oscillations of a melt of the continuous ingot are excited in the upper part of the liquid core of the ingot, and a rotating flow in its lower part, as a result of interaction of the current and at least one continuous magnetic field.

9. A method according to claim 1, wherein axial or radial magnetic fields excited in the upper part of the liquid core of an ingot or in the liquid core of a casting are amplitude or frequency-modulated.

10. A method according to claim 1, wherein the current strength is periodically decreased below a critical value in order to excite a pulsating pinch-effect with a definite time spacing.

11. A method according to claim 10, wherein the time spacing varies in time.

12. A method according to claim 1, wherein the electric current is passed through the upper part of the liquid core of the ingot and mold.

13. A method according to claim 1, wherein the electric current is passed through the liquid core of the ingot, a part of the solid ingot adjacent to the bottom of the liquid core, contactor, two external buses of rectangular cross-section connected in parallel, and arranged rotation-symmetrically with respect to the ingot axis.

14. A method according to claim 1, wherein the electric current is passed through the at least one of the nozzle, jet, and casting head, liquid core of the casting, and air gates of rectangular cross-section arranged rotation-symmetrically with respect to the casting axis.

15. A method according to claim 1, wherein the intensity of the magnetic field excited by the currents flowing in external buses or air gates of the continuous ingot is significantly increased by ferromagnetic backs parallel to the casting axis.

16. The method of claim 1, wherein a strength of the electric current exceeds a critical strength corresponding to an onset of the pulsating pinch-effect.

17. The method of claim 16, wherein the electrical current comprises an alternating current, and the frequency of the pulsating pinch-effect corresponds to a frequency of the alternating current.

18. The method of claim 17, wherein the frequency of the pulsating pinch-effect corresponds to a maximal value of a sinusoidally varying current.

19. The method of claim 1, wherein the generating of the pulsating pinch-effect comprises generation of a two-cycle pulsating pinch effect.

20. The method of claim 1, further comprising generating a magnetic field in an upper portion of the liquid core.

21. The method of claim 20, wherein the magnetic field is generated within a mold to form the continuous metal ingot, the magnetic field is constant, and the magnetic field interacts with the current to generate azimuthal electromagnetic body forces within the liquid core having torsional oscillations with a frequency corresponding to a frequency of the pulsating pinch-effect.

22. The method of claim 20, wherein the magnetic field is generated within a mold to form the continuous metal ingot, and the magnetic field and the current vary in time at a same frequency to generate azimuthal electromagnetic body forces to produce a mean rotary motion and to double a frequency of torsional oscillations generated within the liquid core.

23. The method of claim 1, further comprising generating a rotationally symmetrical magnetic field in a lower portion of the liquid core.

24. The method of claim 23, wherein the lower portion of the liquid core corresponds to a strand of the continuous ingot, the current passes through the entirety of the liquid core, and an interaction between the rotationally symmetrical magnetic field and the current generates at least one of a rotary motion of the melt and azimuthal oscillations within the liquid core in the strand.

25. The method of claim 1, wherein a strength of the current to generate the pulsating pinch effect is determined by:

$$I_{cr} \geq \pi R_o \sqrt{\frac{2\rho g h}{\mu_o}},$$

wherein $I_{cr}$ is the strength of the current, $R_0$ is the radius of the liquid core (m), h is the height of the melt column above the zone of pinch effect origination (m), p is the melt density (kg/m$^3$), g is 9.81 m/s$^2$, and $\mu_0$ is $4\pi\cdot10^{-7}$ (Hn/m).

26. A method of casting a continuous metal ingot, comprising:

storing a liquid metal in a tundish;

discharging the liquid metal from the tundish into a mold through a nozzle in the tundish to form a continuous ingot; and passing an electric current through the discharging liquid metal and a liquid core of the continuous ingot, the discharging liquid metal acting as a liquid conductor for the current, wherein the current is controlled such that an electromagnetic pressure corresponding to the current periodically exceeds a hydrostatic pressure of the liquid conductor to deform and break the continuity of the liquid conductor, generating a pulsating pinch-effect.

27. The method of claim 26, further comprising:

generating an axial magnetic field in a top portion of the mold, wherein the axial magnetic field interacts with the current to generate a mean rotary motion of the liquid core and azimuthal oscillations with a frequency corresponding to one of a frequency of the pulse-pinch pulsations if the axial magnetic field is constant and a double frequency if the magnetic field and the current vary in time with the same frequency.

28. The method of claim 27, further comprising:

generating a two-dimensional rotation-symmetric magnetic field along the length of the liquid core below the top portion of the mold, wherein the two-dimensional rotation-symmetric magnetic field interacts with the current to generate a mean rotary motion of the liquid core and azimuthal oscillations.

29. The method of claim 26, wherein a strength of the current to generate the pulsating pinch effect is determined by:

$$I_{cr} \geq \pi R_o \sqrt{\frac{2\rho g h}{\mu_o}},$$

wherein $I_{cr}$ is the strength of the current, $R_0$ is the radius of the liquid conductor (m), h is the height of the melt column above the zone of pinch effect origination (m), p is the melt density (kg/m$^3$), g is 9.81 m/s$^2$, and $\mu_0$ is $4\pi\cdot10^{-7}$ (Hn/m).

* * * * *